United States Patent [19]

Cherrington

[11] 4,221,503

[45] * Sep. 9, 1980

[54] DRILLING METHOD AND APPARATUS FOR LARGE DIAMETER PIPE

[76] Inventor: Martin D. Cherrington, 5147 Whitney Ave., Carmichael, Calif. 95608

[ * ] Notice: The portion of the term of this patent subsequent to Oct. 24, 1997, has been disclaimed.

[21] Appl. No.: 860,935

[22] Filed: Dec. 15, 1977

[51] Int. Cl.[2] ..... F16L 1/02

[52] U.S. Cl. ..... 405/184; 175/61; 175/73; 405/143

[58] Field of Search ..... 61/42, 72.7, 84, 85, 61/105; 175/26, 45, 61, 62, 73, 75; 299/31, 33; 405/138, 141, 143, 184

[56] References Cited

U.S. PATENT DOCUMENTS

| | | | |
|---|---|---|---|
| 2,565,794 | 8/1951 | Young | 175/61 |
| 3,280,923 | 10/1966 | Muench | 175/73 |
| 3,356,167 | 12/1967 | Trent | 175/62 X |
| 3,465,834 | 9/1969 | Southworth | 175/73 X |
| 3,589,135 | 6/1971 | Ede | 61/105 |
| 3,713,500 | 1/1973 | Russell | 175/73 |
| 3,830,545 | 8/1974 | Sugden | 175/62 X |
| 3,857,449 | 12/1974 | Kimura | 175/26 |
| 3,894,402 | 7/1975 | Cherrington | 175/62 X |
| 3,938,597 | 2/1976 | Richmond et al. | 175/61 X |
| 3,967,463 | 7/1976 | Grandori | 299/33 |
| 4,121,673 | 7/1975 | Cherrington | 175/61 |

*Primary Examiner*—David H. Corbin
*Attorney, Agent, or Firm*—Townsend & Townsend

[57] ABSTRACT

A method and apparatus is disclosed for installing a large diameter pipe—in the range of 30 inches diameter—for spanning an obstacle, such as a river, along an invert arcuate underground path. An inclined drill rig, having a mud supply system and power pod, includes an angularly inclined ramp and driven car for crowding, without rotation, a pipe either pre-bent to a preselected and constant radius of curvature or a straight pipe into the ground. The pipe at its head includes an articulated drill head, which by appropriate articulation, assures placement of the pipe along a radius of curvature equal to the pre-bent radius of curvature of the pipe. The articulated drilling head includes a hydraulic system for articulating and driving the cutting head and pumping mud and tailing from the pipe path. Two discrete mud systems are used. The first mud system is utilized to entrain and carry away cuttings. The second mud system is combined with a flared skirt about the point of drill head articulation to provide a clean and high lubricity annulus of mud about the advancing drill string. The density of the first mud system can be used to vary the drill string mass, while the density of this second mud system can be used to vary the density of the fluid in which the drill string is buoyantly supported.

25 Claims, 9 Drawing Figures

DRILLING METHOD AND APPARATUS FOR LARGE DIAMETER PIPE

This patent application relates to an apparatus and method for implacing a large diameter surface along an invert arcuate path under an obstacle, such as a river. This application is a continuation, in part, of my copending application entitled "System and Method for Installing Production Casing", Ser. No. 740,570, filed Nov. 10, 1976 and my patent application, "Drilling and Installation System", U.S. Patent Application Ser. No. 740,573, filed Nov. 10, 1976 now U.S. Pat. No. 4,121,673.

STATEMENT OF THE PROBLEM

When pipelines reach obstacles, such as rivers, crossing is required. An advantageous system, which I have pioneered, includes drilling in an invert arcuate path underneath such obstacles. Entrance is made on one side, an invert arcuate path drilled, with exit being made on the opposite side. See, for example, my U.S. Pat. Nos. 3,878,903; 3,894,402; 4,003,440; 3,996,758.

Commonly, my technique has included first drilling with a small diameter pilot string (in the order of 3 inch diameter or so). By using logs and knowing with precision the length of the pipe in the ground together with the bearing and elevation of the drill head taken at pre-selected points along the line, an accurate plot along the course of a small pilot string can be made. Thereafter, I have threaded my pilot strings with pipes of larger diameter. Such threading has been for the purpose of preserving the pilot hole, for the purposes of overcoming the ambient frictions along the course of the pipe, as well as for the purpose of having the production casing follow the course of the pilot string in the ground.

My prior art techniques have been restricted in the total diameter of pipe that can be used. Typically, my larger casings are rotated as they are advanced, circumscribing the pilot string. They, thus, follow the invert arcuate path previously established by the pilot string. Naturally, in excavating an annulus about a pre-existing pilot string, rotation of the circumscribing casing is about the only available technique for the advancement of the casing.

As is well known in the strength of material arts, simultaneously rotating and flexing pipes of increasing and larger diameters places stress in the sidewalls of such pipes. As the diameter increases, the structural section modulus of the pipe correspondingly increases—with the forth power of the diameter. Bending of the pipe during rotation becomes impractical and effectively impossible. Moreover, any kind of a change in radius of curvature of the initially installed path, or rotation of the installed production casing along the invert arcuate paths, produces great pipe stressing. Breaking of the pipe in hole can easily occur. Once breaking occurs, a run of pipe can be completely lost.

Moreover, sticking of pipes in the invert arcuate paths is a known problem which I have encountered. Where a pipe must bend to conform to an arcuate path, friction "wall sticking" of the pipe at portions immediate to and in the bend can occur along the walls of the pipe. Moreover, where mud is introduced under pressure along the pipe side walls, this mud under pressure can force the pipe to one of the sides of the hole under the pressure of the mud. This phenomena, known as "differential sticking" can effectively brace a pipe against the side walls of a hole, preventing movement of the pipe altogether.

Regarding the problem of sticking, two phenomena present in soil formations can cause such sticking. The first is hydrostatic pressure, the second is soil overburden.

Regarding soil hydrostatic pressure, this pressure is disturbed by the passing of the drill string. In the case where the drill evacuates under pressure more soil than it displaces, sucking of the formation into drill string can occur. Sticking will result.

In the case where the drill string excavates less soil than the drill string displaces, jamming of the drill string into the soil can occur. Sticking of the drill string in the soil can result.

The problem known as "overburden" adds to this phenomena. In a classical overburden situation, the compression of the soil geologically "remembers" static overburdens, which may no longer exist. For example, where a river bed was once at the bottom of the ocean, and is raised, soil under the river may be in a geologically ancient compressed state. The entry of the drill string into this highly compressed soil will cause soil to collapse around the drill string, resulting in sticking. While this phenomena is rare in areas under rivers, it can occur.

SUMMARY OF THE PRIOR ART

In G. L. Young U.S. Pat. No. 2,565,794 a system of directional drilling is shown, this system being conventionally employed with ordinary diameters of pipe—in the order not exceeding 8 to 10 inches. In this patent substitution for conventional "whipstocks" is made by sections of precurved pipe. The pre-bent pipe is continuously introduced at ground level until the full curvature desired is reached. Thereafter, conventional rotary drilling using straight pipe occurs through the precurved pipe. This type of directional drilling has the pre-curved liner followed by a rotating drill string. As a large diameter pipe will not rotate effectively, utilization of this technique is not appropriate for large diameter pipe. Moreover, one or more segments of lining pipe are required. In large diameters such linings are impractical to install by disclosed prior art systems, and extremely wasteful of material.

Finally, there is no provision made to control with precision radius of curvature of the hole. Without this precision control, over-stressing of the production casing can ocur with resultant fracture.

An articulating drill head is shown in Russell U.S. Pat. No, 3,713,500. This drill head provides for articulation to and from a known angle, with no intermediate position of articulation there between.

In neither of the above techniques are buoyancy and lubricity devices set forth, which buoyancy and lubricity devices enable the low friction drilling necessary for placement of an invert arcuate path over a relatively large distance, such as a distance in the excess of 700 feet.

SUMMARY OF THE INVENTION

A method and apparatus is disclosed for installing a large diameter pipe—in the range of 30 inches diameter—for spanning an obstacle, such as a river, along an invert arcuate underground path. An inclined drill rig, having a mud supply system and power pod, includes an angularly inclined ramp and driven car for crowding, without rotation, a pipe either pre-bent to a preselected and constant radius of curvature or a straight pipe into the ground. The pipe at its head includes an articulated drill head, which by appropriate articulation, assures placement of the pipe along a radius of curvature equal to the pre-bent radius of curvature of the pipe. The articulated drilling head includes a hydraulic system for articulating and drilling the cutting head and pumping mud and tailing from the pipe path. Two discrete mud systems are used. The first mud system is utilized to entrain and carry away cuttings. The second mud system is combined with a flared skirt about the point of drill head articulation to provide a clean and high lubricity annulus of mud about the advancing drill string. The density of the first mud system can be used to vary the drill string mass, while the density of this second mud system can be used to vary the density of the fluid in which the drill string is buoyantly supported. Serendipitously the forces of drill string mass and drill string buoyancy can be balanced with respect to one another to provide neutral buoyancy within wide limits, thus insuring a neutrally buoyant force to prevent common forces of sticking encountered despite wide ranges of pipe size. Advancement of the drill string occurs along an arcuate path of constant curvature from entrance into the ground to exit from the ground by crowding the large diameter pipe only (without rotation) to avoid pipe stressing due to either pipe rotation or change of radius of curvature in the pipe from end to end. Provision is made to precisely monitor drill head site pressures and volume of materials introduced into and taken from the drill site to prevent sticking.

OTHER OBJECTS AND ADVANTAGES OF THIS INVENTION

An object of this invention is to have a large diameter pipe of preset or prebent radius of curvature crowded into the ground in the following relation to an articulated drill head. In accordance with this aspect of the invention, an inclined drill rig is utilized. The rig crowds the pipe of preset radius of curvature into the ground. An inhole hydraulic system powers the drill, provides the force necessary for articulation across a high stiffness bellows joint, and provides a motive force for evacuation of tailings and mud. A first mud system entrains out cuttings. A second mud system, commencing between the bellows and a protective shield, provides a high lubricity mud annulus above the crowded pipe. Insertion of mud along the pipe path can readily occur.

An advantage of this aspect of the invention is that installation without rotation of a production casing from one end of an invert arcuate path to the other end of an invert arcuate path can occur. The need for lining pipes and the like to either impart direction or to reduce friction or preserve a drill hole is not present.

A further advantage of this invention is that installation occurs with a constant and unchanging radius of curvature. Flexing of pipe against either a changing radius of curvature or against the forces of rotation as curved is avoided. The danger of breakage of the inserted production casing is avoided. Large diameter pipes can for the first time be placed in the ground along a curved and drilled path.

A further advantage of this system is that the phenomena known as "wall sticking" can be avoided. As the dimension and radius of curvature of the hole can be precisely matched to the pre-bent and constant radius of curvature of the pipe—"wall sticking" can be virtually eliminated.

A further object of this invention is to disclose a system whereby neutral density of a large diameter pipe being installed in the ground can be achieved. This neutral density can be maintained and achieved and indeed varied within wide limits, in spite of changing ground density conditions encountered en route. According to this aspect of the invention, the lubricating mud system and the tailing transporting mud systems are varied in density with respect to one another. The lubricating mud system as varying in density provides a variable buoyant force. The entraining mud system as varied in density provides a changing mass. By balancing the mass against the buoyant force, neutral density can be achieved.

An advantage of this aspect of the invention is that the mass of the drill string is variable. Dependent upon the soil encountered, the weight of the drill string can be varied.

A further advantage of this invention is that the density of the fluid of floatation of the drill string is variable.

A serendipitous advantage of the ability to vary the density of two mud systems is that the forces of floatation and pipe mass can be varied one against the other. Unlike the normal case, where the forces of floatation are constant, here they can be varied within wide limits to produce neutral buoyancy.

A further object of this invention is to diclose an articulating drill head design. According to this aspect of the invention, the drill head is divided into two sections, these sections connected by a relatively stiff bellows joint. At least two (and preferably four) hydraulic cylinders are connected across the respective sections at the bellows joint, and provided with universal connections between their respective pistons and points of power application. By adjusting cylinder position against the stiff bellows joint, a continuously variable articulation at the drill head can be provided.

An advantage of this aspect of the invention is that the radius of curvature of the hole can be controlled within precise and narrow limits. This control enables the advancement of the pipe into a hole that is in precise conformance to the pre-bent radius of curvature of the large diameter pipe. Stressing of the pipe walls due to change of radius of curvature is minimized.

Yet another object of this invention is to disclose a system for dispensing mud into a hole from such an articulating drill head. According to this aspect of the invention, a depending skirt if attached to the leading section of the drill head. This skirt depends in the direction of drill head travel over the bellows. Mud is dispensed between the forward section of the drill head and the depending skirt. It extrudes outwardly between the skirt and the bellows to encase the pipe in an annulus of high lubricity mud.

An advantage of this aspect of the invention is that the joint is protected by the provided shield.

A further advantage of this aspect of the invention is that the inundation of particulate matter to the bellows joint is prevented. Specifically, the out flow of high lubricity mud prevents the inward penetration of particulate matter that may otherwise damage the expansion joint.

Another object of this invention is to disclose a drilling process in which minimal disturbance of soil is produced. According to this aspect of the invention, the volumetric flow of the mud stream introduced into cutting head is carefully compared to the volumetric displacement produced by crowding the drill stream into the ground. Provision is made to balance precisely materials taken from the excavation with the displacement of the drill stream. Minimal sticking of the drill stream in the soil formation occurs.

An advantage of this aspect of the invention is that the drill string does not evacuate from the ground ambient soils and fluids in excess of loose soils and fluids displaced by the crowded drill string. As a result, the ambient soils are not sucked into the drill string, with the result that sticking of the drill string occurs. Moreover, jamming of the drill string into soil formations without the extraction of a volume of soil equal to the drill string displacement does not occur.

Yet another advantage of this invention is that the muds used in cutting are not introduced in excess of those required to entrain away cuttings. Differential sticking or forcing of the drill head to one side of the hole or to another side of the hole is prevented.

Another object of this invention is to control the pressure and volume of lubricating mud introduced into the annulus about the advancing drill string. According to this aspect of the invention, the ambient through static and/or overburden pressure (whichever is greater) is measured. The lubricating mud is introduced into the annulus around the pipe at precisely this pressure. Moreover, the volume of lubricating mud introduced is controlled to precisely equal volume of the annulus created as the drill string advances. By matching the pressure and volume of the lubricating mud annulus to the pressure and volume of the ambient soil, minimal disturbing of the soild formation occurs.

An advantage of this aspect of the invention is that the ambient soil cannot close in upon the pipe. Rather, since the lubricating mud is at the same pressure in the same volume as the displaced ambient soil from the annulus, minimal disturbance of the surrounding formation occurs and friction is held at a minimum.

Other objects, features, and advantages of this invention will become more apparent after referring to the following specifications and attached drawings which:

Figure 4C:
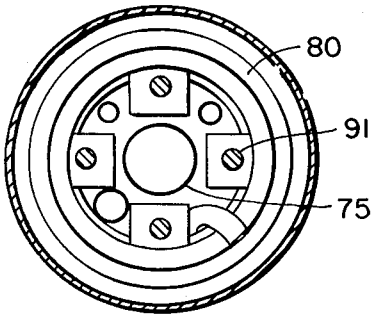
Figure 3A:
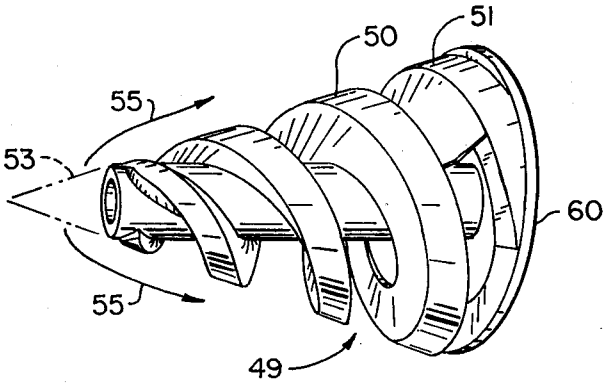
Figure 4B:
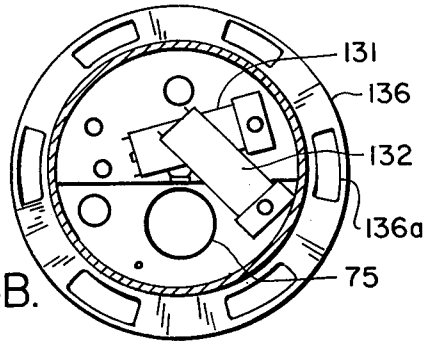
Figure 4A:
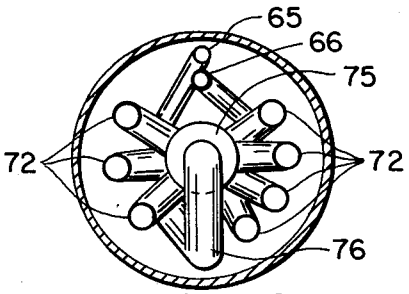
Figure 3B:
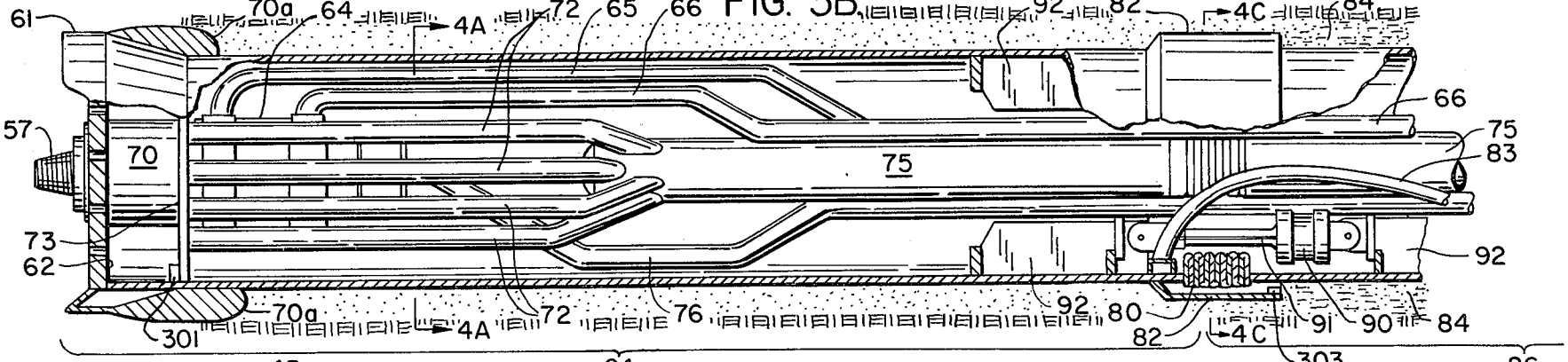
Figure 3C:
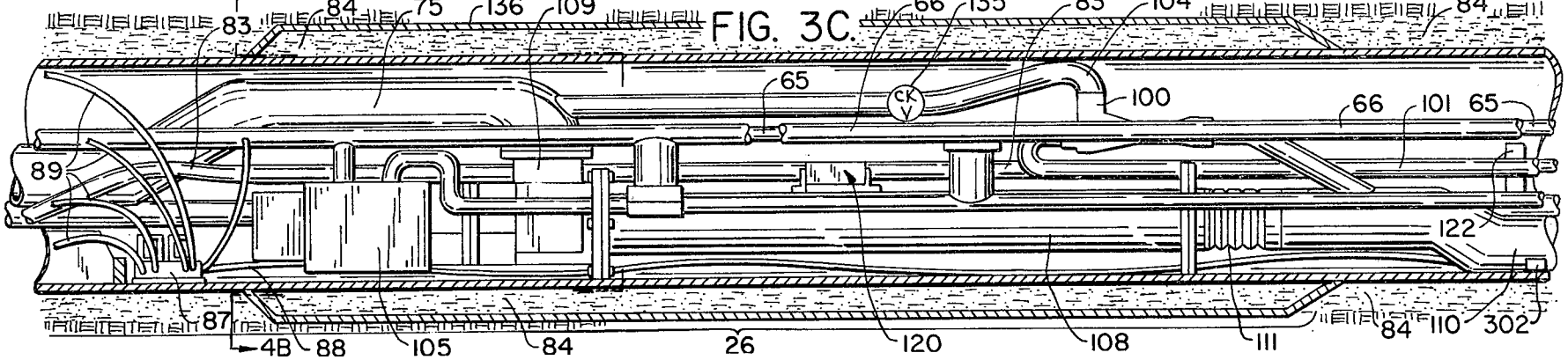

FIGS. 3A, 3B, and 3C are respective side elevation sections of the drill head illustrating the rotating head, the mud transport system, the bellows joint and the system for extruding an annulus of high lubricity mud about the following pipe;

FIG. 4A is a section along lines 4A—4A of FIG. 3A;

FIG. 4B is a section along lines 4B—4B of FIG. 3B;

FIG. 4C is a section along lines 4C—4C of FIG. 3A; and

Figure 5:
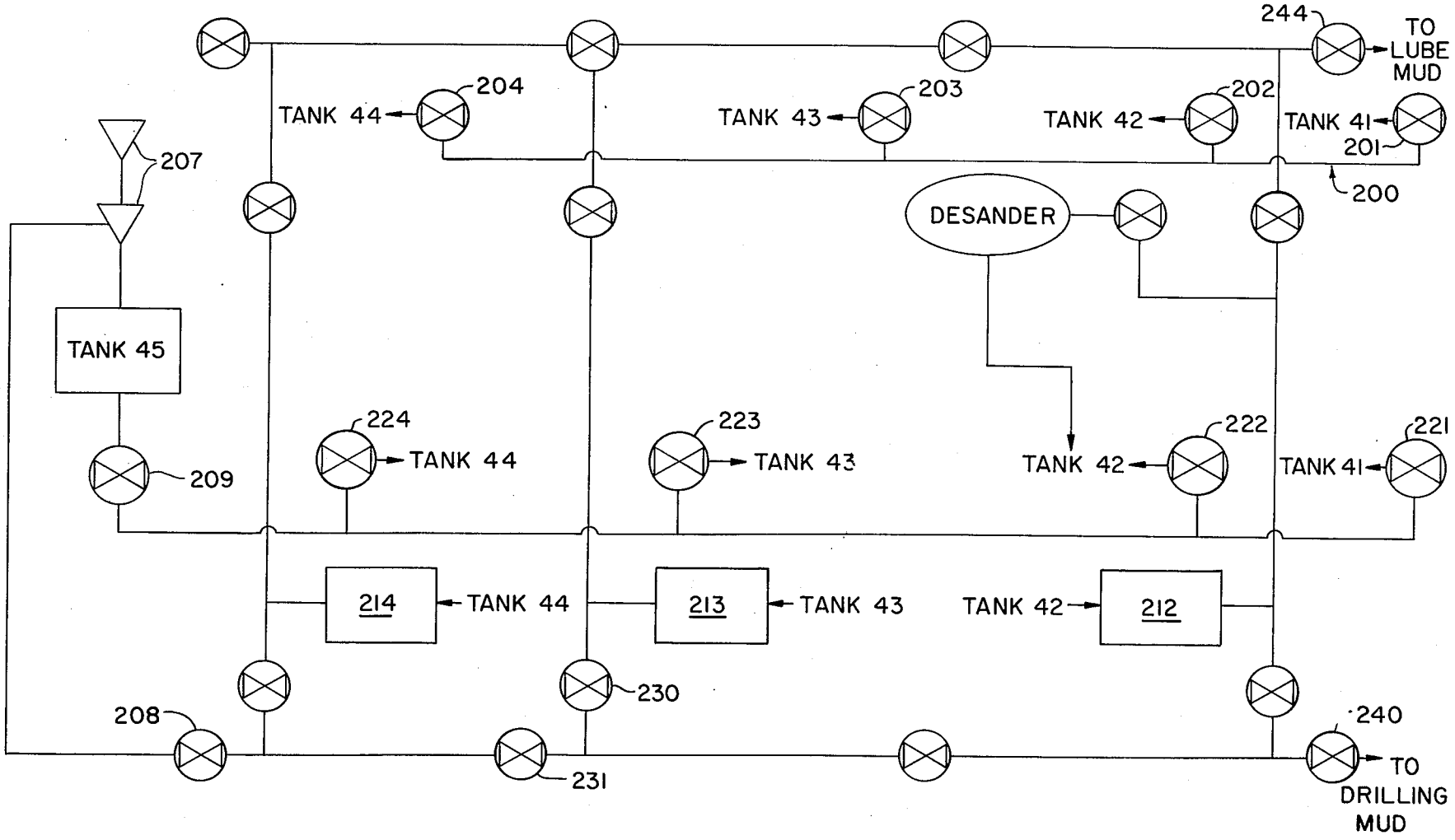

FIG. 5 is a schematic of the mud system used with this invention for providing muds of at least two variable densities.

Figure 1:
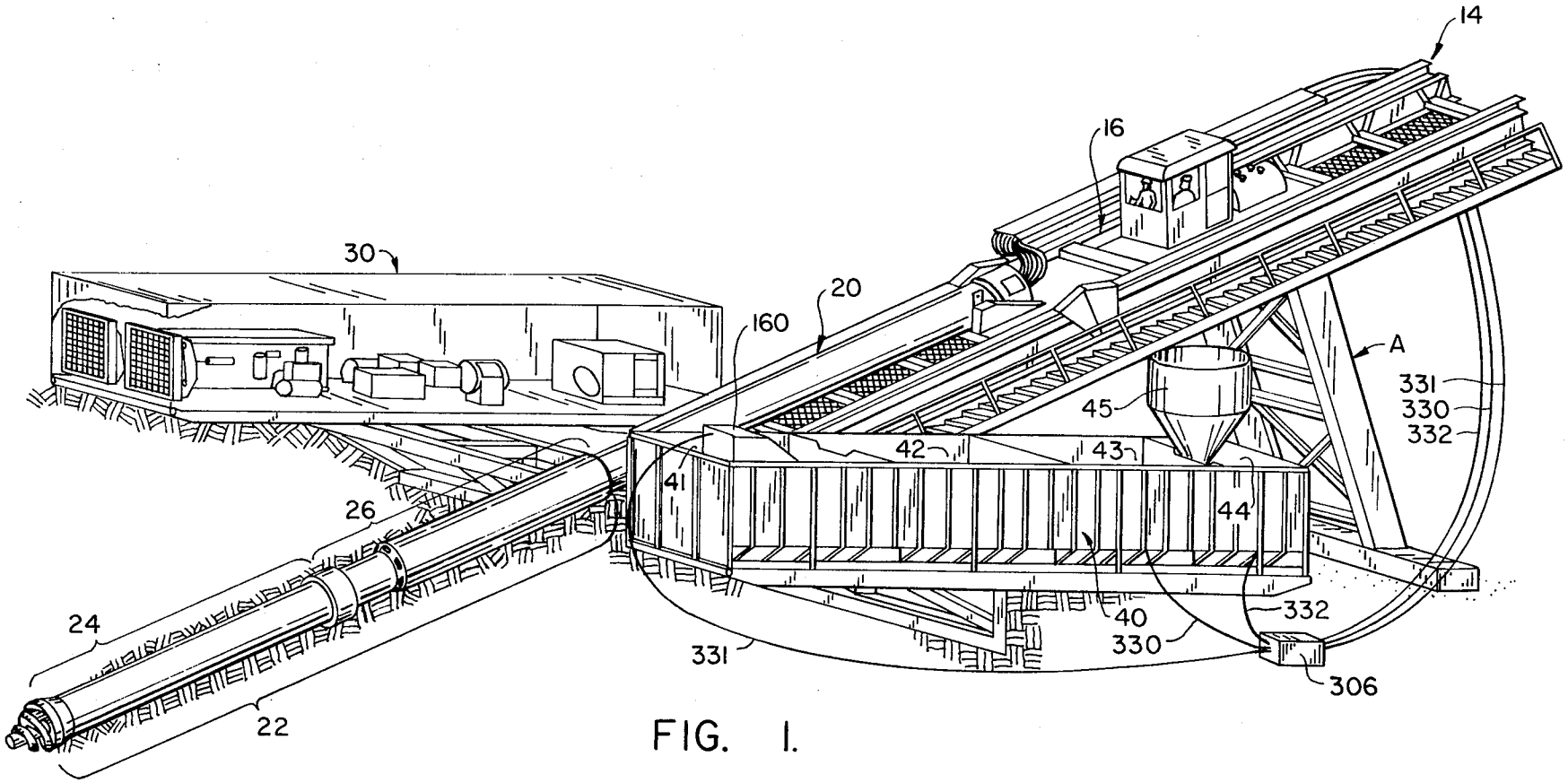
FIG. 1 is a perspective view showing the drilling apparatus of this invention, set up on site with a respective inclined ramp, a separate mud power supply, a separate power unit and a large diameter pipe being crowded along an invert arcuate path under an obstacle such as a river.

Referring to FIG. 1, an inclined drill rig A, having an inclined ramp 14 and a car 16 travelling thereon, is illustrated. Car 16 drives large diameter pipe 20 into the ground under great force, as high as 550,000 pounds of thrust. A car 16 is known and sold under the designation Husky Model 54 manufactured by Richmond Manufacturing Company of Ashland, Ohio. In actual practice, the cylinder and cylinder housings and cylinders can be modified dependent upon the optimum drilling needs required.

Large diameter pipe 20 has attached to the front portion thereof, an articulated drill head 22, consisting of a leading cutting portion 24 and a following pipe attached portion 26, as will hereinafter be made more apparent with respect to FIGS. 3*a* and 3*b*. Portions 24, 26 are capable of relative articulation with respect to one another for placement of large diameter pipe 20 in the hole.

The apparatus of this invention requires auxiliary service. Specifically, a pump module 30 includes hydraulic and mud systems for pumping under power all fluids needed to drive system herein. Specifically, hydraulics are supplied to car 16 to supply its motive force. Secondly, in-hole hydraulic flow is provided for driving of the drill head and positive displacement pumping of mud from the pipe drilled and filled hole. Thirdly, the two mud systems, hereinafter set forth in detail, are supplied by mud pumps.

A mud system 40 is shown. This mud system includes a series of five tanks, 41–45, and a system of communicating mud between the respective tanks, as will be more particularly set forth with respect to FIG. 5.

Figure 2:
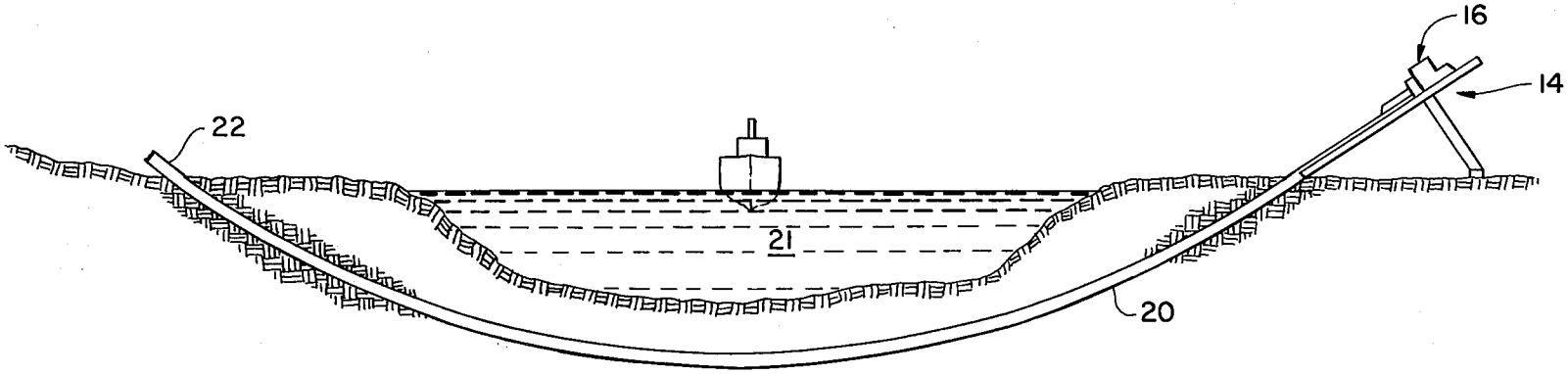
FIG. 2 is a side elevation section of this invention, illustrating the invert arcuate path of an obstacle being crossed from one side of a river to the opposite side of the river.

Referring to FIG. 2, ramp 14 with car 16, illustrated thereon, is shown placing pipe 20 along an invert arcuate path under an obstacle such as river 21. The pipe is here shown extending the full length with the drill head 22 protruding characteristically from the ground on the opposite side of the obstacle. For purposes of the illustration of FIG. 2 it will, of course, be realized that the radius of curvature of the pipe 20 is exaggerated. It will be noticed that the radius of curvature is constant and does not change. It conforms to the preset and typically prebent radius of curvature of the pipe segments, which are sequentially installed at the drill rig 14, as the drill head 22 advances into the ground.

It should be realized that where the applicable strength of material limits are not exceeded, straight pipe can be used. However, the use of pre-bent pipe is herein preferred.

The pipe segments are serially joined together at the drilling rig. Such joinder is by conventional techniques. Preferably, the pipes are butt welded one to another. Hose is placed interiorly of the pipe joined by conventional couplings.

It will be appreciated that when drilling under rivers, ambient ground water will usually occupy the excavated passage. A force of floatation will be present on the pipe. This force of floatation can be varied dependent on the density of the soil encountered.

Referring to FIGS. 3A, 3B and 3C, drilling apparatus of this invention is illustrated. It can best be understood by explaining from left to right the apparatus of this invention.

Remembering that the drill sections 24, 26 do not rotate, but only the cutting head does rotate, and referring to FIG. 3A, a conical drill head is illustrated. This drill head consists of a conical profile having two spiralled and conically contoured abraiding flights of cutting teeth, 50, 51, attached there to. At the leading end, a standard drill head, 53, is attached.

Drill head 53 simultaneously cuts and extrudes mud, as the entire drill head assembly 49 (FIG. 3A) is rotated. Mud 55 passes rearwardly into the interval between the spiralling and conically contoured cutting flights. Drill head 49 is attached to a drill head connection 57, fits at a base 60, within an outwardly flared chamber 61 (see FIG. 3B). A low profile shoe 70A follows the drill head and helps prevent tailings and drilling mud from penetrating behind cutting head 49.

It is preferred that the conically contoured cutting flights 50, 51 themselves extrude mud. Consequently, mud outlets are provided and spaced along these members.

In trailing relationship behind the chamber 61 there is a diaphragm plate 62. Diaphragm plate 62 is apertured with a series of one inch holes therein. These respective one inch holes restrict the size of the particulate mass, entrained in the drilling mud which may pass from the drill head 49 into the interior of leading portion 24 of the articulating drill head. The particles are screened in size, so that the evacuation apparatus, either a positive displacement pump or a Venturi pump, hereinafter illustrated, may affect evacuation of mud and entrailed tailings.

It is necessary that the drill head be powered. Accordingly, a vane motor 64, of the balanced vane variety, is utilized. This motor is a standard item of manufacture, and can be, for example, a Vickers MHT 500, manufactured by the Sperry-Vickers Corporation of Troy, Michigan. Motor 64 is hydraulic. Therefore, input into the motor occurs through a hydraulic pressure conduit 65 to a common hydraulic return 66.

For reasons of economics, as well as desired flexibility, flexible hose is used for the illustrated conduits interior of the pipe throughout this invention. These hose connections can naturally be sequentially added as successive segments of pre-curved pipe 20 are placed within the ground.

Once particulate matter has been loosened by the rotating drill head 49 and passed through the apperture plate 62, it passes to a series of seven three inch mud evacuation pipes 72, communicating through the back wall 73 of chamber 70. These three inch pipes in turn communicate to an 8 inch mud out pipe 75. Inflowing mud to the drill motor is provided through an in mud conduit 76.

Having set forth the forward section 24 of the articulating drill head, attention can now be devoted to the bellows joint construction, separating forward section 24 from after section 26.

A relatively stiff bellows joint 80, is utilized. Specifically, this bellows joint may comprise a series of corrugated rings, fastened one to another, which rings circumscribe and connect forward section 24 with after section 26. These respective rings are overlied by a flared skirt 82, attached to the forward section 24 of the articulating drill head. A high lubricity mud, introduced at conduit 83 extrudes from the flared skirt 82 at an annulus 84. This high lubricity mud continues in its annular extrusion along the entire length of the pipe 20 placed within the ground.

Shield 82 accomplishes a number of functions. First, it floods the high lubricity annulus 84 from the forward low profile shoe **70*a* rearwardly along the entire length of the inserted pipe. Cuttings and entraining mud are excluded from the annulus about the installed pipe. Secondly, it serves to protect and overlie the bellows joint 80. Solid particulate matter cannot penetrate the bellows where flexure of the bellows could produce a rupture. Thirdly, it permits the extruded mud interior of the skirt to pass outwardly and form the desired annulus about the non-articulatedsection 26** of the drill head. Finally, as mud is outflowing from this skirt, and being left behind the drill head in an annulus about the pipe, particles cannot penetrate to the bellows joint against the mud flow. As can readily be understood, the penetration of solid particles into the expanding and contracting bellows joint could damage the joint in its fluid-tight capacity.

Articulation of the pipe joint is accomplished by fluid pistons. These fluid pistons take hydraulic fluid in from a hydraulic pressure line (such as fluid line 65) and are expanded or contracted to provide the desire angularity to the drill head. For example, a solenoid system 87, actuated through an appropriate electrical conduit 88, includes controlling outlets 89 (see lower left portion of FIG. 3C). These hydraulic conduits are communicated to the respective hydraulic cylinders 90, which extend at their respective ends across the bellows joint 80. By the expedient of reading linear potentiometers 91, attached between relatively moving parts of the hydraulic cylinders, and applying pressure differentials across the respective cylinders, the angularity of the drill head can be precisely adjusted to angles, varying from 0 degrees to 5 degrees across the stiff bellows joint 80.

Referring to FIG. 3B, it will be seen that the respective trailing section of forward articulating portion 24 is reinforced by gusset plates 92. Likewise, the leading section of the non-articulating portion 26 of the drill head is correspondingly reinforced by gussets 92. It is to be noted that the number of hydraulic cylinders here used are four—a minimum of at least two such cylinders being required to provide the articulation in both azimuth and elevation. That is to say, the articulated portion 24 of the drill head can be moved from side to side (azimuth), as well as up and down (elevation), to correct this minute adjustment the path of the drill as it proceeds. With this system herein disclosed the pressure differential between top and bottom hydraulic cylinders, can be adjusted to produce desired elevation changes. Likewise, the pressure differential, across the side cylinders can be adjusted to provide changes in azimuth.

Evacuation of the cuttings from the eight inch mud out manifold 75 can occur in two discrete ways. First, the Venturi type pump 100, powered from an incoming mud supply 101 can be used to evacuate the 8 inch out manifold 75, via a drain 104. Secondly, a hydraulicly driven vane motor, such as the the Vickers MHT 32, manufactured by the Sperry-Vickers Corporation of Troy, Mich., designated as unit 105, may receive hydraulic fluid under pressure at 106, and drive an attached Moyno pump 108. Moyno pump 108 communicates at a inlet 109 to an outlet 110, which outlet constitutes an 8 inch hose, connected at a flex coupling 111, to the outlet of the Moyno pump.

Moyno pumps are well known in the drilling art, and constitute rotating pumps of the positive displacement variety capable of pumping mud and particulate matter. However, they have not been used in a motor driven manner from a down-hole location to effect to pump drilling mud and cuttings from a down-hole location to and out a mud conduit 110.

It may be desired to omit the Venturi pump 100. This pump may be absent in the entirety or capped as desired.

It is required that the azimuth and elevation of the drill be sensed as the device proceeds in drilling attitude through the ground. Accordingly, a pitch and roll indicator, 120, is placed in non-articulating portion 26 of the drill head, and azimuth indicator 122—for example, either a gyro or magnetic compass—is placed in the after portion of the drill head. By combining the outputs from these two units on a log together with the length of pipe installed, it is possible to precisely track the course of the pipe as it proceeds through the ground.

It will be noted that, as each successive section of pre-curved pipe 20 is attached, conduits corresponding to the hydraulic conduits and the mud conduits must likewise be attached interiorly of the pipe. As herein contemplated, such conduit installation will consist of lengths of flexible hose with respective couplings effecting attachment. These respective lengths of flexible hose will conform to the interior curvature of the pipe, effect ease of overall handling, and permit expansion and contraction as the need arises for placement of the unit.

Referring to the detail of FIG. 4B, appropriate oil filters 131 and 132 are provided. These respective oil filters maintain the vane pumps in debris-free environment where operation can occur in an uninhibited manner. Likewise, and to prevent back discharge from Moyno pump 108 into the mud evacuation manifold 75, a check valve 135 is placed.

To assure articulation, a bearing annulus 136 is placed around the after section of the drill at the portion illustrated in FIG. 3C. This bearing annulus has two major functions.

First the annulus bears directly against the sides of the bore. By bearing directly against the sides of the bore, it assures that articulation of the drill will produce deviation to the designed and arcuate course through the ground.

Secondly, the annulus 136 is provided with a group of apertures **136*a* through which the high lubricity mud can pass. Thus, the high lubricity mud annulus can pass from one side to the other side of the annulus 136**.

Having set forth configuration of the drill head, the mud system utilized with this invention may now be briefly described.

Broadly, mud is recirculated from the drill rig with cuttings therein to an apparatus 160 for screening out heavy particulate matter. Apparatus 160 may, for example, be a vibrating screen common to the drilling arts. Thereafter, the mud settles into a first tank 41, from which it overflows into a second tank 42. Tank 41 comprises a particle settling tank which may be cleaned through a bottom dump valve as drilling requires. In tank 42 the mud may be pumped to three remaining routes. First, the mud may be stored in tank 43. Secondly, the mud may be stored in tank 44. Finally, the mud may be recirculated to a mixing apparatus, such as illustrated at tank 45 in FIG. 1. The mixing apparatus may be used to adjust the consistency of the mud.

A line diagram is illustrated with respect to FIG. 5, which illustrates the mud flow. Specifically, a water system 200 has respective outlets 201–204 to the respective tanks 41–44.

Secondly, and referring to the bottom left portion of FIG. 5, a surge tank 45 is connected through jet hopper system 207, so that passing slurry can have additional density and consistency added thereto. This connection occurs through valves 208, 209, communication to tanks 41–44 of mud of changed density can occur.

A series of pumps, 212, 213, 214, draw suctions on the respective tanks 42, 43 and 44. These respective pumps communicate at their oulet to piping loops, which piping loops enable the transmission of numerous fluid paths with respect to each tank.

Valves 221, 222, 223, and 224 communicate to the respective tanks 42, 43, and 44. Assuming that all valves illustrated in FIG. 5 are in the closed position, it can be seen that a flow of slurry from any of the tanks can be directed by surge tank 45 for the additional input of slurry solids will achieve an appropriate "jell". For example, by turning pump 213 on, and opening valves 230, 231, and 208, 209, slurry can be circulated by the respective surge tank and mixed into tank 43 until appropriate jell is received. Likewise, by appropriate connection, it can be easily seen that mixing and transfer between any of the respective other tanks can occur.

It will be discovered in the piping grid, illustrated in FIG. 5, the transfer of slurry between any of the respective tanks, 41, 42, 43, 44 and 45, is possible. Moreover, by opening valve 240 or 244, transfer of the slurry to the pumping apparatus to either the two discrete slurry systems of drilling mud or of lube mud of this invention can be accomplished.

It will be understood that the power module 30 is not completely illustrated. Specifically, this unit includes mud pumps for each mud system and hydraulic units sufficient to drive and drill the apparatus shown. As such items are well known state-of-the-art appliances, they will not be further set forth herein.

In order to prevent disturbance of the soil formation in accordance with the process of my invention, I install pressure sensors in my drill head. Typically these pressure sensors are pressure transducers sold under the trademark H220B, manufactured by the Martin Decker Corporation of Santa Ana, Calif. A first pressure transducer 301 is installed in chamber 70. This pressure transducer measures the mud pressure at the cutting head.

A second pressure transducer, 302, which is used for control purposes, measures the pressure of mud being excavated under pressure from the displacing pumps.

A final pressure transducer 303 measures the pressure of the lubricating mud in the annulus immediately about the casing.

Additionally, I measure all mud flowing into and out of the hole. such a metering system is illustrated at item 306 in FIG. 1. Conduit 330 supplied drilling mud; conduit 331 returns drilling mud; conduit 332 supplies lubricating mud. It should be appreciated that measurements could likewise be made by measuring the discrete level of liquids received and taken from the respective tanks 41–45. Likewise, since positive displacement pumps are utilized throughout this apparatus and method, metering can as well occur at these pumps.

PROCESS OF THIS INVENTION

As the drill string advances into the ground, two quantities are known. First, the volumetric displacement of the advancing drill string is known. This volumetric displacement includes two quantities. Second, the ambient soil pressure is known and measure.

The first quantity is the volume of soil actually displaced by the drill string. Taking the case of an inserted 30 inch diameter pipe within a 36 inch diameter hole, volumetric displacement of the pipe can be computed. Since a 36 inch hole is excavated, the difference between the displaced portion of the pipe and the excavated portion of the hole is supplied in lubricating mud extruded in the wake of the pipe passing through the ground.

Secondly, I match the pressure of the outflowing mud at sensor 303 to the ambient pressure encountered of the drill head at sensor 301. Thus, the extruded mud annulus about the pipe is both in the same volume and at the same pressure as the ambient hydrostatic pressure or soil overburden (whichever is greater) encountered as the pipe passes along and through the ambient soil formation.

It can thus be seen that the combined process has the unique property of providing minimal disturbance to the soil formation. First, the entire drill string is maintained neutrally buoyant. Since it is closed at the forward end by chamber 70, it is capable of having its own buoyant force. By the expedient of varying the density of the drilling mud within the pipe and the density of the mud annulus about the pipe, I can control the neutral buoyancy of the drill string within a wide limit.

Secondly, and as the drill string advances, I make sure that the excavations from the hole equal precisely the amount of soil displaced. Thus, the drill string is neither jammed into the soil formation, nor is the drill string evacuate more from the soil formation than it actually displaces.

Thirdly, the pressure forces are precisely balanced. Specifically, the lubricating mud pressure, sensed by sensor 303 is maintained equal to the ambient soil pressure sensed by sensor 301. Likewise the volume of lubricating mud is carefully controlled. Thus, the tendency to produce ambient sticking along the path of the pipe is curtailed.

The term "non-rotatably" has been used to describe the advancement of the emplaced casing. It should be understood that it is contemplated to rock the production casing 20 from side to side to prevent sticking. Complete rotation, however, is not included or contemplated by this disclosure.

It will be appreciated, that the application herein sets forth both an apparatus and process for the placement of large diameter casings into the ground. Likewise, changes in the scope and embodiment of this invention can be made without departing from the spirit of this invention.

What is claimed is:

1. A method for emplacing a casing beneath an obstacle between first and second locations at or near to ground level comprising the steps of: excavating a liquid-occupied passageway having a preselected diameter along an invert arcuate path under said obstacle between said locations; introducing a casing of lesser diameter than said passageway along said passageway; introducing and metering a transport fluid at the site of said excavating; entraining the cuttings from said excavating in the transport fluid; non-rotatably advancing said casing into and along the arcuate path of said passageway; collecting and metering said transport fluid and entrained cuttings in the interior of the leading portion of said casing; evacuating the transport fluid and entrained cuttings under positive pressure from the interior of the leading portion of said casing to prevent the cuttings from settling in the ground circumscribing the advancing casing; maintaining the excess of collected transport fluid and entrained cuttings over introduced transport fluid to substantially equal the amount of soil formation displaced by said casing; sealing off the interior of said casing proximate the leading portion thereof to provide buoyancy to the casing within the passageway; and weighting the casing to substantially neutralize said buoyancy to minimize friction between the casing and the sidewalls of the passageway to facilitate advancement of said casing into the passageway.

2. A method according to claim 1 wherein said weighting step comprises the steps of selecting the characteristics of supply and return conduits passing through the interior of the casing, so that the weight of said supply and return conduits with their contents substantially neutralizes the buoyancy of the casing.

3. A method according to claim 1 further including sealing the outer circumference of said casing and the circumscribing ground from the interior of said casing to form a sealed-off annulus and introducing a lubricating fluid into said sealed-off annulus, said casing being weighted to substantially neutralize the buoyancy of said casing in said lubricating fluid.

4. A method according to claim 1 wherein said evacuating step comprises driving a positive displacement pump disposed within the leading portion of said casing to evacaute the transport fluid and entrained cuttings under positive pressure from the interior of the leading portion of said casing.

5. A method for emplacing a casing along an invert arcuate path beneath an obstacle between first and second locations at or near ground level comprising the steps of: excavating a passageway in soil formations having a preselected diameter along said invert arcuate path having a generally constant radius of curvature under said obstacle between said locations; providing a plurality of casing segments, each casing segment having a preformed radius of curvature corresponding to the radius of curvature of said arcuate path; joining said casing segments from one of said locations to form a continuous casing of said constant radius of curvature along said invert arcuate path; introducing and metering transporting fluid at the site of said excavation; extraining the cuttings from said excavation in said transporting fluid; non-rotatably advancing said casing into and along the arcuate path of said passageway; collecting and metering said transporting fluid and entrained cuttings in the interior of the the leading portion of said casing; maintaining the excess of collected transporting fluid and entrained cuttings over said introduced fluid to substantially equal the amount of said soil formation displaced by said casing; sealing off the interior of said casing approximate the leading portion thereof to provide buoyancy to said casing within the passageway; and weighting the casing to substantially neutralize the buoyancy to minimize friction between the casing and the sidewalls of said passageway to facilitate the advancement of said casing into the passageway.

6. The method of claim 5 and including the step of extruding an annulus of high lubricity mud about said casing segments.

7. The method of claim 5 and wherein said metering steps include passing fluid through positive displacement pumps.

8. The method of claim 5 and wherein said weighting step comprises varying the density of said transporting fluid.

9. A method for emplacing a casing beneath an obstacle along an invert arcuate path between first and second locations at or near ground level comprising the steps of: excavating a passageway at a cutting head in soil formations having a preselected diameter along an invert arcuate path having a generally constant radius of curvature under said obstacle; providing a plurality of casing segments, each segment having a preformed radius of curvature corresponding to the radius of curvature of said arcuate path, said provided casing segments having a diameter less than the diameter of said excavated invert arcuate path; joining said casing segments end to end to form a continuous curved casing having said preformed radius of curvature in trailing relation to said cutting head; introducing a transporting fluid at the site of said excavating; entraining the cuttings from said excavating in the transporting fluid; non-rotatably advancing said casing into and along the arcuate path of said passageway; collecting said transporting fluid and entrained cuttings in the interior of the leading portion of said casing; evacuating the transporting fluid and entrained cuttings under positive pressure from the interior of the leading portion of said casing to prevent the cuttings from settling in the ground circumscribing the advancing casing; providing a seal around the periphery of the excavated hole separating the cutting head from an annulus defined between the diameter of said casing segments and the diameter of said excavated hole; and introducing under pressure a correspondent volume of lubricating mud into said annulus, said lubricating mud substantially equalling the volume of said defined annulus as said string proceeds in the ground; the pressure of said introduced lubricating mud being substantially equal to the ambient pressure encountered in the ground.

10. The method of claim 9 and including the steps of weighting said casing to a neutral buoyancy by varying the density of said transporting fluid relative to said lubricating mud in said annulus to achieve neutral buoyancy of said casing.

11. A method for emplacing a casing beneath an obstacle between first and second locations at or near ground level comprising the steps of providing a drill head having a rotating drill bit of a first diameter; providing a plurality of casing segments of a second and lesser diameter adapted to be serially joined to form a continuous casing, each having a preformed radius of curvature corresponding to the desired radius of curvature of a drill path; excavating a passageway of said first diameter along said path; crowding and serially attaching said casing segments behind said drill head to advance said casing into the ground along said path having said constant radius of curvature; introducing and metering transporting fluid at the side of said excavating; entraining cuttings from said excavating in the transporting fluid; collecting and metering said transporting fluid and entrained cuttings in the interior leading portion of said casing to maintain the excess of collected fluid and entrained cuttings over introduced fluid equal to volumetric displacement of said casing as said casing proceeds into the ground; providing a seal between said cutting head and said casing to seal the cutting portion of said drill from the annulus defined by said passageway about said casing; introducing and metering a volume of lubricating mud in the annulus, said volume being equal to the volume of said annulus created as said casing moves through the ground; and weighting the casing to substantially neutralize the buoyancy of said casing in said lubricating mud to minimize the friction between the casing and sidewalls of the passageway to facilitate an advancement of said casing into the passageway.

12. The invention of claim 11 in wherein said introducing step includes introducing under pressure said lubricating mud at a pressure at least equal to the ambient hydrostatic or overburden pressure, whichever is greater, of the soil encountered by said casing.

13. The invention of claim 11 and wherein weighting step comprises varying the densities of at least one of a group consisting of said transporting fluid and said lubricating mud.

14. Apparatus for drilling and simultaneously installing a relatively large production casing along an invert arcuate path beneath an obstacle from a first position at or near ground level on one side of the obstacle to a second position at or near ground level on the other side of the obstacle comprising: a plurality of production casing segments, each having preformed curvature corresponding to the radius curvature of said arcuate path, said casing segments adapted to be serially joined end to end to form a continuous production casing; means for crowding said casing along said path; a drill head located in front of the leading end of said casing; means for mounting the drill head to the casing so that the angular orientation of the drill head, relative to the axis of the leading end of said casing is at least partially adjustable; a drill bit located in the front of said drill head and mounted thereto; means within the drill head for driving the drill bit to excavate a passageway along said path in advance of said casing, said path having a diameter larger than said casing to create an annulus in the wake of said drill head; means for controlling the angular orientation of the drill head relative to the axis of the leading end of the casing so that the passageway is excavated along said path and the casing installed therealong, said means for controlling the angular orientation of said drill head including a joint connecting a first portion of said drill head to a second portion of said drill head; a skirt attached to the first portion of said drill head depending over said joint; a conduit for introducing lubricating mud between said skirt and said first portion of said drill head to permit lubricating mud to pass into the annulus created by said drill head; means for injecting lubricating mud through the lubricating mud conduit, so that the lubricating mud is expelled proximate the leading end of said casing to lubricate the casing as it advances along said excavated passageway.

15. The apparatus of claim 14 and including conduit means communicated to and from said drill head for confining a stream of transporting fluid to and from said drill head for transporting cuttings from said drill head.

16. The apparatus of claim 14 and wherein said conduit includes pump means proximate said drill head for moving said transporting fluid and cuttings from said drill head.

17. The apparatus of claim 14 and including a pressure sensor for measuring pressure of said transporting fluid at said drill head.

18. The apparatus of claim 14 and including a pressure sensor at said means for injecting lubricating mud for measuring the pressure of said lubricating mud.

19. A method for emplacing a casing beneath an obstacle along an invert arcuate path between first and second locations at or near ground level comprising the steps of: excavating a passageway at a cutting head having a preselected diameter along an invert arcuate path having a generally constant radius of curvature under said obstacle; introducing a casing having a diameter less than the diameter of said excavated passageway; introducing a transport fluid at the site of said excavating; entraining the cuttings from said excavating in the transport fluid; non-rotatably advancing said casing into and along the arcuate path of said passageway; collecting said transport fluid and entrained cuttings in the interior of the leading portion of said casing; evacuating the transport fluid and entrained cuttings under positive pressure from the interior of the leading portion of said casing to prevent the cuttings from settling in the ground circumscribing the advancing casing; providing a seal around the periphery of the excavated hole separating the cutting head from an annulus defined between the diameter of said casing and the diameter of said excavated passageway; and introducing under pressure a correspondent volume of lubricating mud into said annulus, said lubricating mud substantially equalling the volume of said defined annulus as said casing proceeds in the ground, the pressure of said introduced lubricating mud being substantially equal to the ambient pressure encountered in the ground.

20. The method of claim 19 and including the steps of weighting said casing to a neutral buoyancy by varying the density of said transport fluid relative to said lubricating mud in said annulus to achieve neutral buoyancy of said casing.

21. Apparatus for drilling and simultaneously installing a casing along an invert arcuate path beneath an obstacle from a first position at or near ground level on one side of the obstacle to a second position at or near ground level on the other side of the obstacle comprising: means for crowding said casing along said path; a drill head located in front of the leading end of said casing; means for mounting the drill head to the casing so that the angular orientation of the drill head, relative to the axis of the leading end of said casing is at least partially adjustable; a drill bit located in the front of said drill head and mounted thereto; means within the drill head for driving the drill bit to excavate a passageway along said path in advance of said casing, said passageway having a diameter larger than said casing to create an annulus in the wake of said drill head; means for controlling the angular orientation of the drill head relative to the axis of the leading end of the casing so that the passageway is excavated along said path and the casing installed therealong, said means for controlling the angular orientation of said drill head including a joint connecting a first portion of said drill head to a second portion of said drill head; a skirt attached to the first portion of said drill head depending over said joint; a conduit for introducing lubricating mud between said skirt and said first portion of said drill head to permit lubricating mud to pass into the annulus created by said drill head; means for injecting lubricating mud through the lubricating mud conduit, so that the lubricating mud is expelled proximate the leading end of said casing to lubricate the casing as it advances along said excavated passageway.

22. The apparatus of claim 21 and including conduit means communicated to and from said drill head for confining a stream of transport fluid to and from said drill head for transporting cuttings from said drill head.

23. The apparatus of claim 21 and wherein said conduit includes pump means proximate said drill head for moving said transporting fluid and cuttings from said drill head.

24. The apparatus of claim 21 and including a pressure sensor for measuring pressure of said transporting fluid at said drill head.

25. The apparatus of claim 21 and including a pressure sensor at said means for injecting lubricating mud for measuring the pressure of said lubricating mud.

* * * * *